US008226201B2

(12) United States Patent
Sumida et al.

(10) Patent No.: US 8,226,201 B2
(45) Date of Patent: Jul. 24, 2012

(54) IMAGE RECORDING APPARATUS AND METHOD OF DETECTING EJECTION FAILURE IN PRE-PROCESSING AGENT EJECTION NOZZLES IN IMAGE RECORDING APPARATUS

(75) Inventors: Ryuhei Sumida, Kyoto (JP); Masanori Fujiwara, Kyoto (JP)

(73) Assignee: Dainippon Screen MFG Co., Ltd., Kyoto (JP)

( * ) Notice: Subject to any disclaimer, the term of this patent is extended or adjusted under 35 U.S.C. 154(b) by 533 days.

(21) Appl. No.: 12/406,598

(22) Filed: Mar. 18, 2009

(65) Prior Publication Data

US 2009/0289985 A1 Nov. 26, 2009

(30) Foreign Application Priority Data

May 20, 2008 (JP) ..... 2008-131702

(51) Int. Cl.
*B41J 29/393* (2006.01)

(52) U.S. Cl. ..... 347/19; 347/14; 347/21; 347/67

(58) Field of Classification Search ..... 347/19, 347/14, 15, 21, 9, 67
See application file for complete search history.

(56) References Cited

U.S. PATENT DOCUMENTS 5,898,443 A * 4/1999 Yoshino et al. ..... 347/19
6,953,238 B2 * 10/2005 Koitabashi et al. ..... 347/43
7,101,017 B2 * 9/2006 Endo et al. ..... 347/19
7,318,637 B2 * 1/2008 Ishimoto et al. ..... 347/19
2004/0125162 A1 * 7/2004 Valero et al. ..... 347/16
2005/0073547 A1 * 4/2005 Endo ..... 347/19
2006/0158472 A1 * 7/2006 Endo ..... 347/14

FOREIGN PATENT DOCUMENTS

GB 2 391 306 A 2/2004
JP 09-066650 3/1997
JP 11-058930 3/1999
JP 3372681 11/2002

OTHER PUBLICATIONS

European Search Report issued in European Patent Application No. 09 00 3979.3 dated Dec. 8, 2009.

* cited by examiner

*Primary Examiner* — Matthew Luu
*Assistant Examiner* — Henok Legesse
(74) *Attorney, Agent, or Firm* — McDermott Will & Emery LLP

(57) ABSTRACT

The ejection positions of a plurality of pre-processing agent ejection nozzles and the ejection positions of a plurality of ink ejection nozzles as seen in a direction orthogonal to the transport direction of a recording medium are in a one-to-one correspondence with each other. A controller causes the process of ejecting ink of a first color from the ink ejection nozzles onto the recording medium subjected to the ejection from the plurality of pre-processing agent ejection nozzles so as to form a failure detection printing pattern which is a printing pattern formed by providing a time lag between the processes of ejecting the ink from adjacent ones of the plurality of ink ejection nozzles. An ejection failure in the pre-processing agent ejection nozzles is detected by judging that a pre-processing agent ejection nozzle corresponding to a region where bleeding results suffers the ejection failure.

4 Claims, 8 Drawing Sheets

1

IMAGE RECORDING APPARATUS AND METHOD OF DETECTING EJECTION FAILURE IN PRE-PROCESSING AGENT EJECTION NOZZLES IN IMAGE RECORDING APPARATUS

BACKGROUND OF THE INVENTION

1. Field of the Invention

The present invention relates to an image recording apparatus for recording an image on a recording medium by ejecting ink from ink ejection nozzles based on inkjet technology. More particularly, the invention relates to an image recording apparatus which applies a pre-processing agent to a recording medium before ejecting ink to record an image on the recording medium.

2. Description of the Background Art

In an image recording apparatus for recording an image based on inkjet technology, an ink ejection failure occurs in some cases because ink ejection nozzles are clogged or air bubbles enter an ink supply path. A variety of methods have been proposed in the past to detect an ink ejection nozzle suffering the ejection failure.

An example of such methods is known in which ink is ejected from a plurality of nozzles for forming adjacent dots or neighboring dots at different times to print a test pattern and a determination as to whether each of the nozzles ejects ink well or not is made from the result of printing. This method is disclosed in, for example, Japanese Patent Application Laid-Open No. 9-66650 (1997).

On the other hand, there is a method in which, before an image recording apparatus records an image on a recording medium poor in ink fixability, that is, a recording medium having low ink absorbency, an ink receiving layer for enhancing the fixability of ink to the recording medium is applied onto the surface of the recording medium. An example of this method is known in which, prior to the recording of an image, a pre-processing agent which is a material constituting the ink receiving layer is applied onto an arbitrary region on the recording medium based on inkjet technology. This method is disclosed in, for example, Japanese Patent Application Laid-Open No. 11-58930 (1999) and Japanese Patent No. 3372681.

A pre-processing agent less visible (e.g., transparent or substantially transparent) than the ink for use in image recording is often used when the pre-processing agent is ejected and applied onto the recording medium based on inkjet technology, as in the techniques disclosed in Japanese Patent Application Laid-Open No. 11-58930 (1999) and Japanese Patent No. 3372681. It is also important to detect an ejection failure in nozzles (pre-processing agent ejection nozzles) for ejecting such a pre-processing agent.

However, the use of the above-mentioned method of printing the test pattern as disclosed in Japanese Patent Application Laid-Open No. 9-66650 (1997) to detect the ejection failure in the pre-processing agent ejection nozzles presents a problem to be described below. When the less visible pre-processing agent is used, it is difficult to discriminate between a region coated with the pre-processing agent ejected from a normal nozzle and a region not well coated with the pre-processing agent because of the ejection failure in a nozzle. This makes it accordingly difficult to detect the nozzle suffering the ejection failure.

SUMMARY OF THE INVENTION

The present invention is intended for an image recording apparatus for recording an image on a recording medium by ejecting ink from ink ejection nozzles based on inkjet technology.

According to the present invention, the image recording apparatus comprises: a transport element for transporting a recording medium; a first recording head having a plurality of ink ejection nozzles and for ejecting ink of a first color for image recording from the plurality of ink ejection nozzles based on inkjet technology; a pre-processing agent ejection head having a plurality of pre-processing agent ejection nozzles and for ejecting a pre-processing agent for enhancing the fixability of the ink to the recording medium from the plurality of pre-processing agent ejection nozzles based on inkjet technology; and a controller for controlling a transport operation in the transport element and ejection operations in the first recording head and in the pre-processing agent ejection head, wherein the ejection positions of the plurality of pre-processing agent ejection nozzles and the ejection positions of the plurality of ink ejection nozzles on the recording medium as seen in a direction orthogonal to a transport direction in which the recording medium is transported by the transport element are in a one-to-one correspondence with each other, and wherein, while causing the transport element to transport the recording medium, the controller causes the process of detecting an ejection failure in the plurality of pre-processing agent ejection nozzles by causing the following processes of: ejecting the pre-processing agent from the plurality of pre-processing agent ejection nozzles onto substantially the entire surface of the recording medium; and ejecting the ink of the first color from the plurality of ink ejection nozzles onto the recording medium subjected to the ejection from the plurality of pre-processing agent ejection nozzles so as to form a failure detection printing pattern, the failure detection printing pattern being a printing pattern formed by providing a time lag between the processes of ejecting the ink from adjacent ones of the plurality of ink ejection nozzles.

In a region of the recording medium where the pre-processing agent is not well ejected from a pre-processing agent ejection nozzle, the low fixability of the ink of the first color to the recording medium causes bleeding to occur in the printing pattern formed by the ink of the first color. Thus, the ejection failure in the pre-processing agent ejection nozzles is detected by judging that the pre-processing agent ejection nozzle corresponding to the region where the bleeding occurs suffers the ejection failure.

Preferably, the image recording apparatus further comprises a second recording head having a plurality of ink ejection nozzles and for ejecting ink of a second color from the plurality of ink ejection nozzles based on inkjet technology, the second color being different from the first color, wherein, in the process of detecting the ejection failure in the plurality of pre-processing agent ejection nozzles, the controller causes the following processes of: ejecting the pre-processing agent; ejecting the ink of the first color; and ejecting the ink from the plurality of ink ejection nozzles of the second recording head onto substantially the entire surface of the recording medium subjected to the ejection from the plurality of pre-processing agent ejection nozzles.

In the region where the pre-processing agent is not well ejected, the ink of the first color and the ink of the second color mix together to result in bleeding. The increase in the amount of ink which causes the bleeding to result allows the detection of the ejection failure in the pre-processing agent ejection nozzles with higher accuracy.

Preferably, the image recording apparatus further comprises: an image reading element for reading an image formed on the recording medium; and a failure judgment element for judging whether there is an ejection failure in the plurality of pre-processing agent ejection nozzles or not, based on a result of reading by means of the image reading element for the failure detection printing pattern, wherein the failure detecting printing pattern includes a plurality of lines formed by the ejection of ink from different ones of the ink ejection nozzles, and wherein the failure judgment element detects the width of each of the plurality of lines formed by the ink of the first color, and when there is an excess-width line having a width falling outside a predetermined threshold value among the plurality of lines, the failure judgment element judges that a pre-processing agent ejection nozzle corresponding in the ejection position to an ink ejection nozzle of the first recording head which is used to form the excess-width line is a nozzle suffering the ejection failure.

This allows the detection of the pre-processing agent ejection nozzle suffering the ejection failure.

The present invention is also intended for a method of detecting an ejection failure in a plurality of pre-processing agent ejection nozzles in an inkjet image recording apparatus.

According to the present invention, the method comprises the steps of: (a) transporting the recording medium; (b) ejecting the pre-processing agent for enhancing the fixability of ink from the plurality of pre-processing agent ejection nozzles included in a pre-processing agent ejection head onto substantially the entire surface of the recording medium; and (c) ejecting the ink of a first color from the plurality of ink ejection nozzles onto the recording medium subjected to the ejection from the plurality of pre-processing agent ejection nozzles so as to form a failure detection printing pattern, the failure detection printing pattern being a printing pattern formed by providing a time lag between the processes of ejecting the ink from adjacent ones of the plurality of ink ejection nozzles included in a first recording head, wherein the ejection positions of the plurality of pre-processing agent ejection nozzles and the ejection positions of the plurality of ink ejection nozzles as seen in a direction orthogonal to a transport direction in which the recording medium is transported are in a one-to-one correspondence with each other.

In a region of the recording medium where the pre-processing agent is not well ejected from a pre-processing agent ejection nozzle, the low fixability of the ink of the first color to the recording medium causes bleeding to occur in the printing pattern formed by the ink of the first color. Thus, the ejection failure in the pre-processing agent ejection nozzles is detected by judging that the pre-processing agent ejection nozzle corresponding to the region where the bleeding occurs suffers the ejection failure.

Preferably, the method further comprises the step of (d) ejecting the ink of a second color from the plurality of ink ejection nozzles included in a second recording head onto substantially the entire surface of the recording medium subjected to the ejection from the plurality of pre-processing agent ejection nozzles, the second color being different from the first color.

In the region where the pre-processing agent is not well ejected, the ink of the first color and the ink of the second color mix together to result in bleeding. The increase in the amount of ink which causes the bleeding to result allows the detection of the ejection failure in the pre-processing agent ejection nozzles with higher accuracy.

Preferably, the method further comprises the steps of: (e) reading the failure detection printing pattern formed on the recording medium by means of an image reading element included in the image recording apparatus; and (f) judging whether there is an ejection failure in the plurality of pre-processing agent ejection nozzles or not, based on a result of reading by means of the image reading element for the failure detection printing pattern, wherein the failure detecting printing pattern includes a plurality of lines formed by the ejection of ink from different ones of the ink ejection nozzles, and wherein the step (f) includes the steps of (f-1) detecting the width of each of the plurality of lines formed by the ink of the first color, and (f-2) when there is an excess-width line having a width falling outside a predetermined threshold value among the plurality of lines, judging that a pre-processing agent ejection nozzle corresponding in the ejection position to an ink ejection nozzle of the first recording head which is used to form the excess-width line is a nozzle suffering the ejection failure.

This allows the detection of the pre-processing agent ejection nozzle suffering the ejection failure.

It is therefore an object of the present invention to provide an image recording apparatus capable of detecting an ejection failure in pre-processing agent ejection nozzles, and a method of detecting an ejection failure therein.

These and other objects, features, aspects and advantages of the present invention will become more apparent from the following detailed description of the present invention when taken in conjunction with the accompanying drawings.

DESCRIPTION OF THE PREFERRED EMBODIMENTS

<Image Recording Apparatus>

Figure 1:
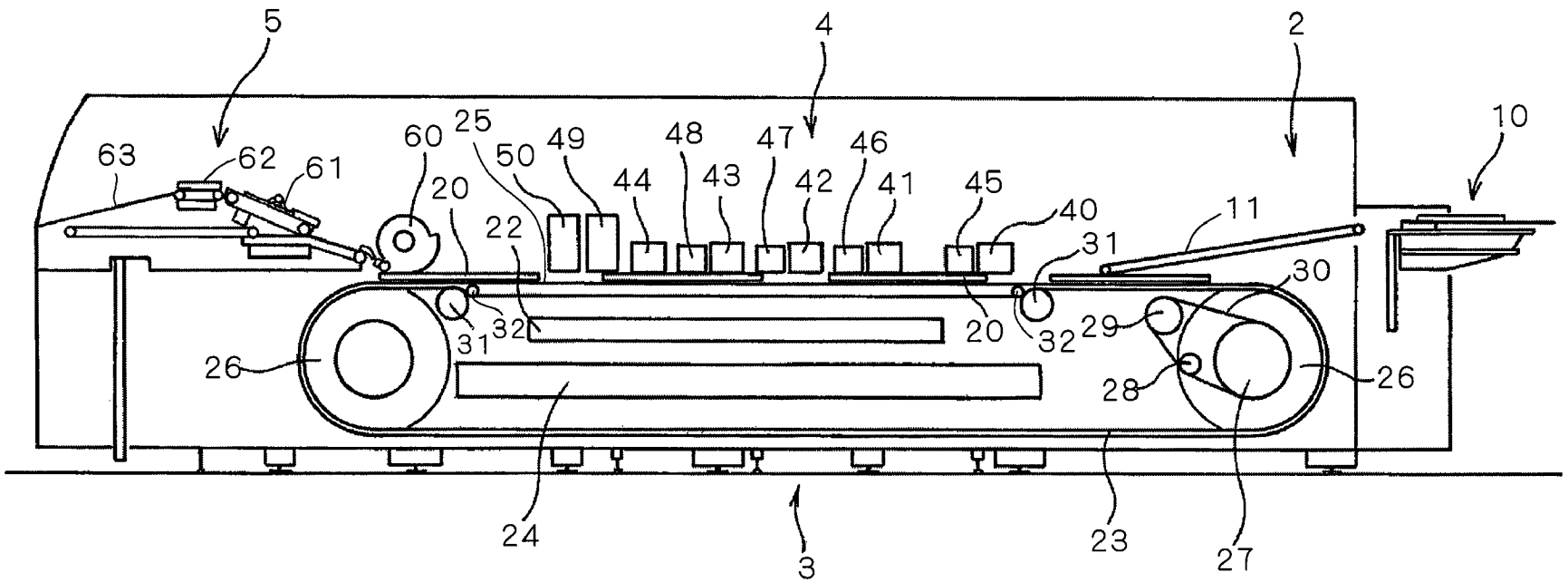
FIG. 1 is a side sectional view showing the construction of an image recording apparatus according to a preferred embodiment of the present invention.
Figure 2:
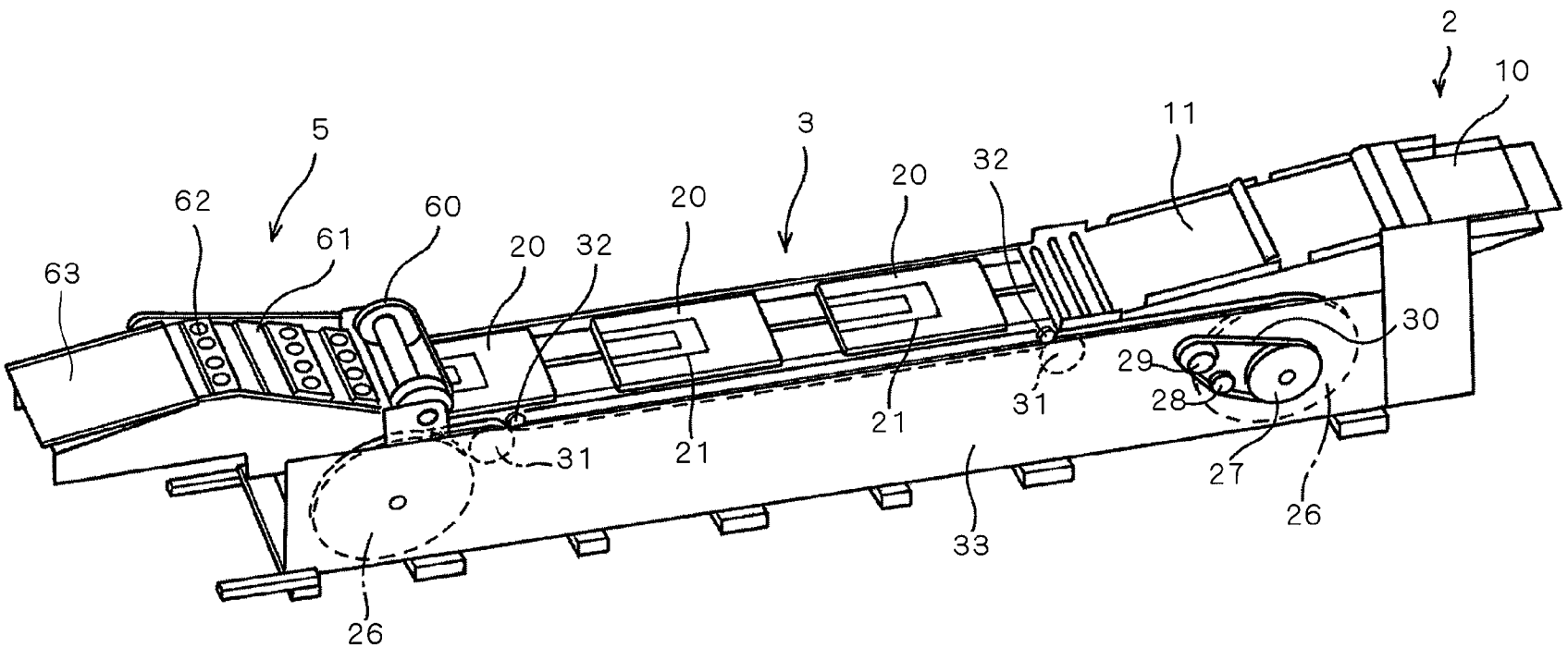
FIG. 2 is a perspective view showing the construction of the image recording apparatus, with an image recording part omitted.

FIG. 1 is a side sectional view showing the construction of an image recording apparatus 1 according to a preferred embodiment of the present invention. FIG. 2 is a perspective view showing the construction of the image recording apparatus 1, with an image recording part 4 omitted.

The image recording apparatus 1 is an apparatus for recording an image on a recording medium RM (with reference to FIG. 6) based on inkjet technology. The recording of an image is accomplished by ejecting ink from orifices of a multiplicity of nozzles (ink ejection nozzles) provided in recording heads 41, 42, 43 and 44 included in the image recording apparatus 1 to cause the ink to adhere to the recording medium RM.

The recording medium RM is not limited to paper for use in typical image recording apparatuses, but may be made of a material capable of widely accepting ink, such as cloth, plastic films, leather and the like. In this preferred embodiment, a sheet of printing paper shall be used as an example of the recording medium RM.

The image recording apparatus 1 includes a paper feed part 2, a table movement mechanism 3 for moving tables 20 capable holding respective recording media RM thereon, the image recording part 4, and a paper output part 5.

The paper feed part 2 is a part for transporting recording media RM placed therein one by one to the table movement mechanism 3, and includes a storage part 10, and a conveyor 11.

The storage part 10 places the recording media RM thereon, and attracts the recording media RM placed thereon one by one from the top under suction to transport the recording media RM one by one to the conveyor 11.

The conveyor 11 holds thereon a recording medium RM transported from the storage part 10, and transports the recording medium RM downstream in the transport direction of the recording medium RM to transfer the recording medium RM to a table 20 included in the table movement mechanism 3.

The table movement mechanism 3 holds the recording medium RM received from the paper feed part 2 on the table 20 under suction to transport the recording medium RM to the image recording part 4. The table movement mechanism 3 moves the table 20 accurately during image recording in the image recording part 4, and moves the table 20 to the paper output part 5 after the image recording. The table movement mechanism 3 principally includes the tables 20 each capable of holding a recording medium RM thereon under suction through a suction hole 21 provided therein, a vacuum fan 22, a chain 23, a linear motor mechanism 24, a pair of linear guide rails 25, sprockets 26, 27, 28 and 29, a chain 30, and sprockets 31 and 32.

The tables 20 are moved at a high speed along an endless track by an endless transport mechanism composed of the pair of sprockets 26 serving as roller members and the chain 23 serving as a funicular element. When an image is recorded on a recording medium RM held on a table 20 in the image recording part 4, the table 20 is disengaged from the endless transport mechanism, and the mechanism for moving the table 20 is changed from the endless transport mechanism to the linear motor mechanism 24 (to be described in detail later). This enables the table 20 to travel accurately during the image recording. At this time, linear guide receiving portions (not shown) disposed at the four corners of the table 20 are integral with the pair of (left-hand and right-hand) linear guide rails 25 disposed on opposite side panels 33 shown in FIG. 2. The pair of rails 25 are of an endless configuration. The table 20 is movable along the endless track by being guided by an endless linear guide composed of the linear guide rails 25 and the linear guide receiving portions.

The table 20 has the suction hole 21 (with reference to FIG. 2), and is adapted to hold a recording medium RM on the surface thereof under suction by means of the suction hole 21. Specifically, the table 20 is hollow in structure, and the surface of the table 20 is formed with the suction hole 21 in communication with the hollow portion of the table 20. The vacuum fan 22 is provided under the path of travel of the table 20. The vacuum fan 22 exhausts air to thereby allow the recording medium RM supplied onto the surface of the table 20 to be held on the table 20 under suction.

The pair of sprockets 26 are rotatably disposed on one of the side panels 33 (with reference to FIG. 2) of the image recording apparatus 1. The chain 23 is looped around the pair of sprockets 26.

The sprocket 27 is attached to one side of one of the sprockets 26. The sprocket 27 is coupled to the driving sprocket 28 driven by driving a motor and the driven sprocket 29 with the chain 30. As the driving sprocket 28 is driven, the chain 23 looped around the pair of sprockets 26 accordingly moves around.

The two pairs of sprockets 31 and 32 changes the vertical position of the chain 23 in some portion of the endless track so that the table 20 is transferred from the endless transport mechanism to the linear motor mechanism 24 before the table 20 arrives at the image recording part 4 and so that the table 20 is transferred from the linear motor mechanism 24 to the endless transport mechanism after the image is recorded on the recording medium RM held on the table 20 in the image recording part 4.

The linear motor mechanism 24 includes a movable element (not shown) attachable to and detachable from the table 20 under the table 20, and a stator (not shown) extending in the direction of travel of the table 20. With the movable element coupled to the table 20, the table 20 is moved by changing the magnetic polarity of the stator.

The table 20 is transported by the linear motor mechanism 24 during the image recording on the recording medium RM held on the table 20 in the image recording part 4, and is transported by the endless transport mechanism using the chain 23 described above except during the image recording. Specifically, the chain 23 and the table 20 are decoupled from each other before the image recording (i.e., before the table 20 is opposed to a pre-processing agent ejection head 40 to be described later), and are coupled to each other again after the image recording (i.e., after the table 20 is opposed to the recording heads 41, 42, 43 and 44, heaters 45, 46, 47, 48 and 49, and a scanner 50 in sequential order). Such an arrangement enables the endless transport mechanism to move the plurality of tables 20 along the endless track at a high speed, and enables the linear motor mechanism 24 to move the plurality of tables 20 accurately in a single direction during the image recording.

The image recording part 4 is a part provided over the table movement mechanism 3 and for recording an image on a recording medium RM held under suction on the top surface of a table 20 moved in a single direction by means of the table movement mechanism 3 based on inkjet technology. The image recording part 4 includes the pre-processing agent ejection head 40, the four recording heads 41, 42, 43 and 44, the five heaters 45, 46, 47, 48 and 49, and the scanner 50. The pre-processing agent ejection head 40 and the recording heads 41 to 44 are also referred to collectively and simply as a head.

The pre-processing agent ejection head 40 is provided to apply a pre-processing agent to the recording medium RM before the four recording heads 41 to 44 are used to record an image on the recording medium RM. The pre-processing agent is applied to the recording medium RM for the purpose of enhancing the fixability of ink to the recording medium RM when the recording medium RM used for the recording of the image in the image recording apparatus 1 is poor in ink fixability, that is, low in ink absorbency. The pre-processing agent used oftentimes is transparent or substantially transparent.

The four recording heads 41, 42, 43 and 44 are as follows: the recording head 41 for black ink, the recording head 42 for cyan ink, the recording head 43 for magenta ink, and the recording head 44 for yellow ink. As shown in FIG. 1, the recording heads 41 to 44 are arranged in a direction in which the recording media RM are transported (leftwardly as seen in FIG. 1) in the order named over the table movement mechanism 3. The details of the structure of the pre-processing agent ejection head 40 and the recording heads 41 to 44 will be described later.

The five heaters 45, 46, 47, 48 and 49 are as follows: the heater 45 for pre-heating, the heaters 46, 47 and 48 for intermediate heating, and the heater 49 for main heating. The heaters 45 to 49 are configured to blow hot air onto the recording media RM transported to the positions opposed to the heaters 45 to 49, and serve to dry the recording media RM.

The scanner 50 is a device for measuring the density of the entire recorded image and a recorded patch, and is provided over the table movement mechanism 3 and downstream from the recording heads 41 to 44 as seen in the transport direction of the recording media RM. In the image recording apparatus 1, the scanner 50 includes a linear CCD camera. The scanner 50 is not limited to the linear CCD camera, but may employ an area sensor and the like.

The paper output part 5 is a part for discharging a recording medium RM transported thereto by the table movement mechanism 3 after the image is recorded on the recording medium RM in the image recording part 4. The paper output part 5 includes a paper output drum 60, conveyors 61 and 62, and a paper output table 63.

The paper output drum 60 separates the recording medium RM held on a table 20 under suction and transported by the operation of the table movement mechanism 3 after the image is recorded on the recording medium RM in the image recording part 4 from the table 20 by winding the recording medium RM around an outer peripheral portion thereof.

The conveyors 61 and 62 serve to transport the recording medium RM separated from the table 20 by the paper output drum 60 to the paper output table 63. Specifically, the conveyor 61 transports the recording medium RM received from the paper output cylinder 60 while holding the recording medium RM thereon to transfer the recording medium RM to the conveyor 62, and the conveyor 62 transports the recording medium RM received from the conveyor 61 to the paper output table 63 while holding the recording medium RM thereon to transfer the recording medium RM to the paper output table 63.

The paper output table 63 is a part for collecting the recording media RM transported thereto. The recording media RM transferred from the conveyor 62 are sequentially placed on the paper output table 63.

In the image recording apparatus 1 having the above-mentioned construction, a recording medium RM fed from the paper feed part 2 is supplied onto a table 20 traveling by means of the endless transport mechanism in the table movement mechanism 3. After the table 20 is transferred from the endless transport mechanism to the linear motor mechanism 24 in the table movement mechanism 3, the image recording part 4 records an image on the recording medium RM. Then, after the table 20 is transferred from the linear motor mechanism 24 to the endless transport mechanism, the recording medium RM on the table 20 is discharged to the paper output part 5.

<Construction of Pre-Processing Agent Ejection Head and Recording Heads>

Next, the construction of the pre-processing agent ejection head 40 and the recording heads 41 to 44 will be described. In this preferred embodiment, the pre-processing agent ejection head 40 and the recording heads 41 to 44 shall be identical in structure with each other.

Figure 3:
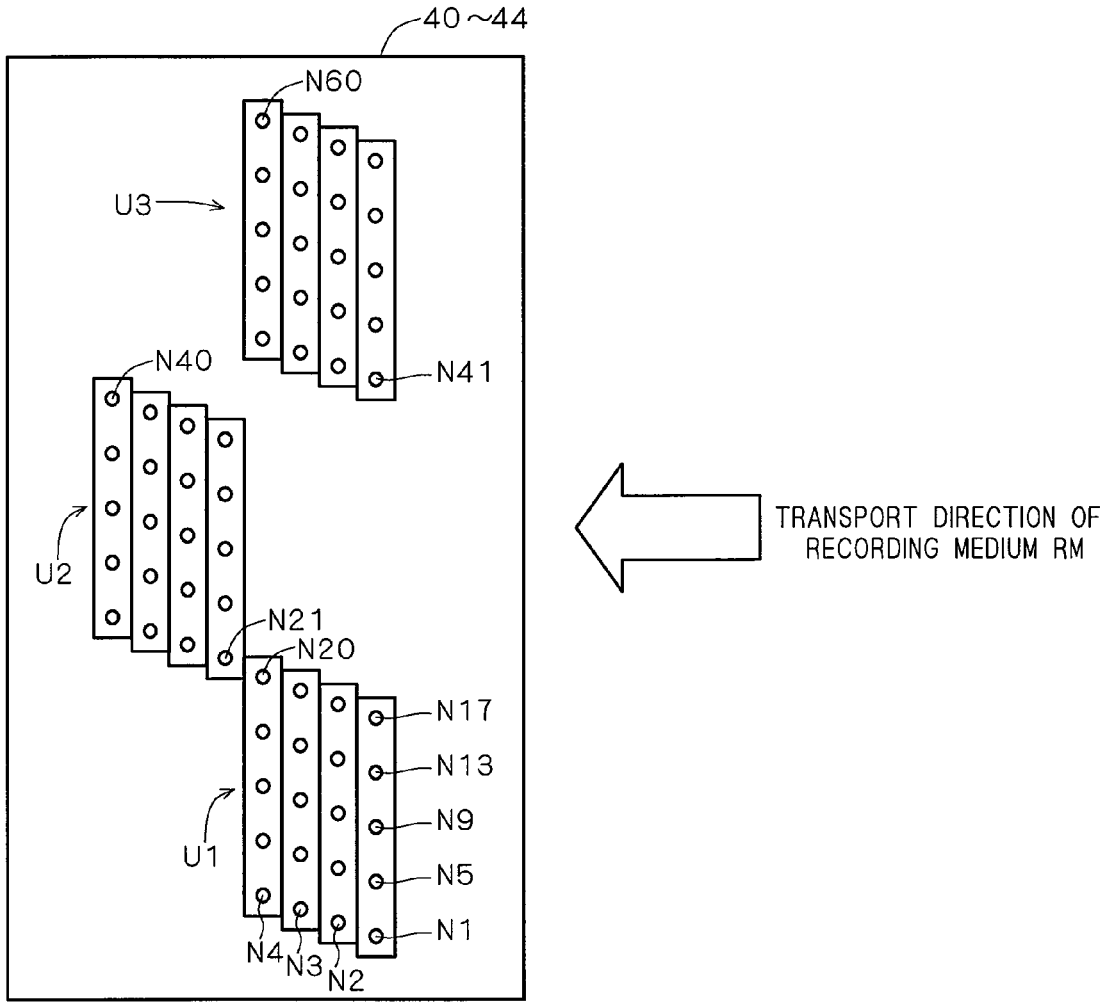
FIG. 3 is a view showing an example of the construction of a pre-processing agent ejection head and recording heads.

FIG. 3 is a view showing an example of the construction of the pre-processing agent ejection head 40 (that is, an example of the construction of the recording heads 41 to 44). FIG. 3 is a view of the pre-processing agent ejection head 40 as seen from the bottom of FIG. 1. The direction in which the recording medium RM is transported (in the leftward direction as seen in FIG. 3) is also shown in FIG. 3. For convenience of description, the pre-processing agent ejection head 40 (and each of the recording heads 41 to 44) having 60 nozzles N1 to N60 will be taken as an example in this preferred embodiment.

The pre-processing agent ejection head 40 includes three head units U1, U2 and U3 arranged in a staggered configuration from bottom to top as seen in FIG. 3 (toward the viewer as seen in FIG. 1) in the order named. The head units U1, U2 and U3 has the nozzles N1 to N20, the nozzles N21 to N40, and the nozzles N41 to N60, respectively. In each of the head units U1 to U3, the 20 nozzles are arranged in four columns disposed stepwise or in echelon, each of the columns being composed of five nozzles disposed in a line vertically as seen in FIG. 3.

The term "adjacent nozzles" or "nozzles adjacent to each other" used herein shall mean that the nozzles are positioned nearest to each other in a vertical direction as seen in FIG. 3. In other words, a first nozzle and a second nozzle adjacent to the first nozzle are a pair of nozzles which are able to eject ink so as to form dots adjacent to each other in a vertical direction as seen in FIG. 3. In FIG. 3, the nozzles N1, N2, N3, . . . , N59 and N60 are arranged in adjacent relationship from bottom to top as seen in the figure in the order named.

Specifically, in the head unit U1, the nozzle N1 and the nozzle N2 are adjacent nozzles, and the nozzle N3 in addition to the nozzle N1 is adjacent to the nozzle N2. The nozzle N3 and the nozzle N5 are adjacent to the nozzle N4. The nozzle N20 in the head unit U1 and the nozzle N21 in the head unit U2 are adjacent to each other, and the nozzle N40 in the head unit U2 and the nozzle N41 in the head unit U3 are adjacent to each other.

The pre-processing agent ejection head 40 is capable of ejecting ink onto an area whose dimension extending in a direction orthogonal to the transport direction of the recording medium RM (in the vertical direction as seen in FIG. 3) is greater than the width of the recording medium RM.

With such an arrangement, the multiplicity of nozzles are arranged at high linear density in the vertical direction as seen in FIG. 3.

The control of the amount and timing of ejection of the pre-processing agent from the nozzles enables the pre-processing agent ejection head 40 constructed as mentioned above to eject a predetermined amount of pre-processing agent onto any region of the recording medium RM.

As an example, ejecting the pre-processing agent linearly in the vertical direction as seen in FIG. 3 by means of the nozzles N1 to N20 of the head unit U1 will be described. First, when a region of the recording medium RM transported from the right as seen in the FIG. 3 onto which the pre-processing agent is to be applied is opposed to the nozzles N1, N5, N9, N13 and N17 (a first column of nozzles), a predetermined amount of pre-processing agent is ejected from the nozzles N1, N5, N9, N13 and N17 toward the recording medium RM.

Subsequently, the recording medium RM with the pre-processing agent applied thereto by the first column of nozzles is transported. When the region of the recording medium RM onto which the pre-processing agent is to be applied reaches a position opposed to the nozzles N2, N6, N10, N14 and N18 (a second column of nozzles), the pre-processing agent is ejected from the second column of nozzles. Thus, the ejection of the pre-processing agent from the second column of nozzles lags behind the ejection of the pre-processing agent from the first column of nozzles. In this manner, the time lag provided between the ejection of the pre-processing agent from the first column of nozzles and the ejection thereof from the second column of nozzles enables the first column of nozzles and the second column of nozzles to eject the pre-processing agent in the same position as seen in the vertical direction of FIG. 3.

Similarly, the ejection from the nozzles N3, N7, N11, N15 and N19 (a third column of nozzles) lags a predetermined period behind the ejection from the second column of nozzles, and the ejection from the nozzles N4, N8, N12, N16 and N20 (a fourth column of nozzles) lags a predetermined period behind the ejection from the third column of nozzles. Adjusting the timing of the ejection of the pre-processing agent from the nozzles in this manner allows the pre-processing agent to be applied linearly in the vertical direction as seen in FIG. 3.

The structure of the pre-processing agent ejection head 40 as an example is described above. The control of the amount and timing of ejection of the ink from the nozzles in the recording heads 41 to 44 also enables the recording heads 41 to 44 to eject the ink onto a desired region of the recording medium RM.

The ejection positions of the nozzles N1 to N60 provided in the pre-processing agent ejection head 40 and the ejection positions of the nozzles N1 to N60 of the recording heads 41 to 44 similar in structure to the pre-processing agent ejection head 40 as seen in the direction orthogonal to the transport direction of the recording medium RM are in a one-to-one correspondence with each other. In other words, the nozzles N1 of the pre-processing agent ejection head 40 and the recording heads 41 to 44 are adapted to eject the pre-processing agent and ink in the same position as seen in the direction orthogonal to the transport direction of the recording medium RM. The same holds true for the nozzles N2 to the nozzles N60.

<Control System for Image Recording Apparatus>

Next, a control system for the image recording apparatus 1 will be described.

Figure 4:
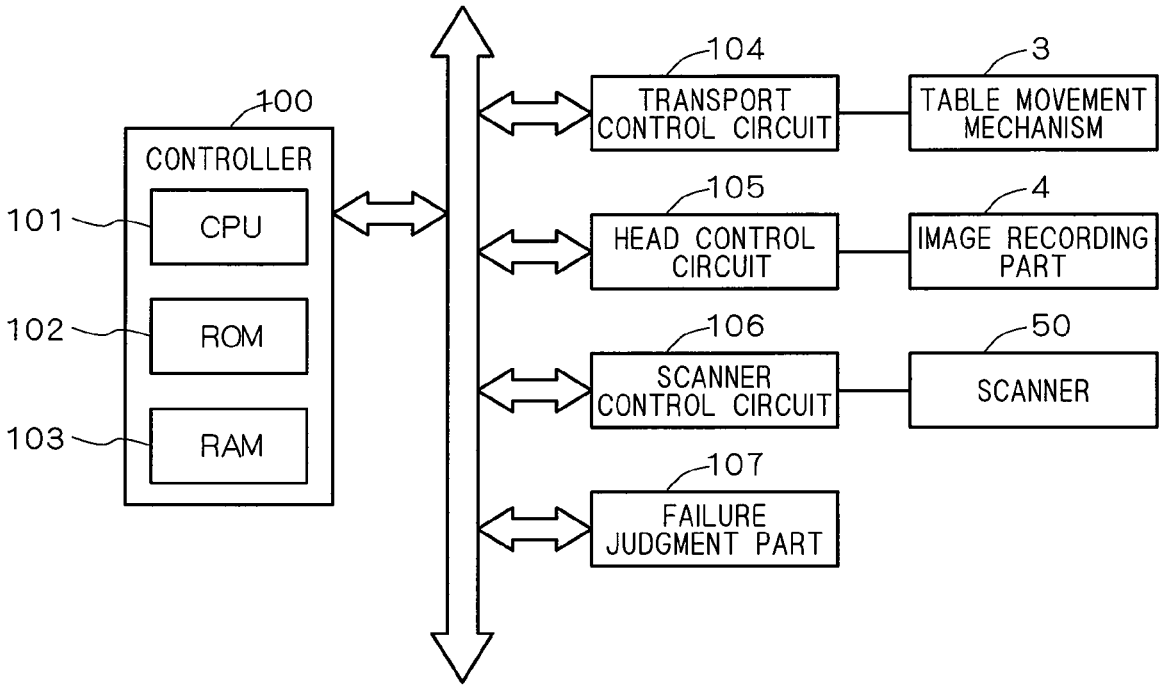
FIG. 4 is a diagram showing the construction of a control system for the image recording apparatus.

FIG. 4 is a diagram schematically showing the construction of the control system for the image recording apparatus 1. The control system for the image recording apparatus 1 principally includes: a controller 100 including a CPU 101, a ROM 102 and a RAM 103, a transport control circuit 104, a head control circuit 105, a scanner control circuit 106, and a failure judgment part 107.

The controller 100 performs processing related to the image recording in the image recording apparatus 1 and data processing in the components of the image recording apparatus 1, and controls the components thereof in a centralized manner. As mentioned above, the controller 100 includes the CPU 101, the ROM 102 and the RAM 103 to implement the functions thereof.

The CPU 101 performs the data processing in the components of the image recording apparatus 1 and controls the components thereof.

The ROM 102 has stored therein a program and the like related to procedures for recording an image on the recording medium RM by using the image recording apparatus 1. The CPU 101 reads and executes the program stored in the ROM 102 to thereby perform the data processing in the components of the image recording apparatus 1 and control the components thereof in a centralized manner.

The ROM 102 also has stored therein a program required for the execution of the process of detecting an ejection failure in the pre-processing agent ejection nozzles according to the present invention. For the execution of the process of detecting a nozzle suffering the ejection failure, the CPU 101 reads and executes the program stored in the ROM 102 to thereby cause the components of the image recording apparatus 1 to function.

The RAM 103 is used as a work area in which data is temporarily stored during the data processing and control of the components of the image recording apparatus 1. For example, the RAM 103 stores image data received from a host device such as a personal computer not shown and the like in a predetermined area thereof.

The transport control circuit 104 controls the driving of the table movement mechanism 3, i.e. the endless transport mechanism and the linear motor mechanism 24, in accordance with driving conditions provided from the controller 100.

The head control circuit 105 controls the ejection of the pre-processing agent from the pre-processing agent ejection head 40 and the ejection of the ink from the recording heads 41 to 44 in accordance with driving conditions provided from the controller 100. The head control circuit 105 also controls the heating by means of the heaters in conjunction with the driving of the heads.

The scanner control circuit 106 controls the scanner 50 in accordance with driving conditions provided from the controller 100.

The failure judgment part 107 performs a failure judgment process for identifying a pre-processing agent ejection nozzle suffering the ejection failure. The identification of the nozzle suffering the ejection failure is made based on the result of printing of test patterns on the recording medium RM, which will be described later. The failure judgment part 107 may be a virtual component implemented by the function of the controller 100.

<Procedure for Process of Detecting Ejection Failure in Pre-Processing Agent Ejection Nozzles>

Next, a procedure for the process of detecting the ejection failure in the pre-processing agent ejection nozzles (also referred to simply as an ejection failure detection process) will be described. The process to be described below is implemented by the controller 100 controlling the components of the image recording apparatus 1.

The processes in the pre-processing agent ejection head 40, in the recording heads 41 and 44, and in the scanner 50 to be described below are performed when a region to be processed on the recording medium RM reaches a position in which the processes are executable. That is, the processes in the pre-processing agent ejection head 40, in the recording heads 41 and 44, and in the scanner 50 are performed in different regions on the recording medium RM in parallel, as required.

Figure 5:
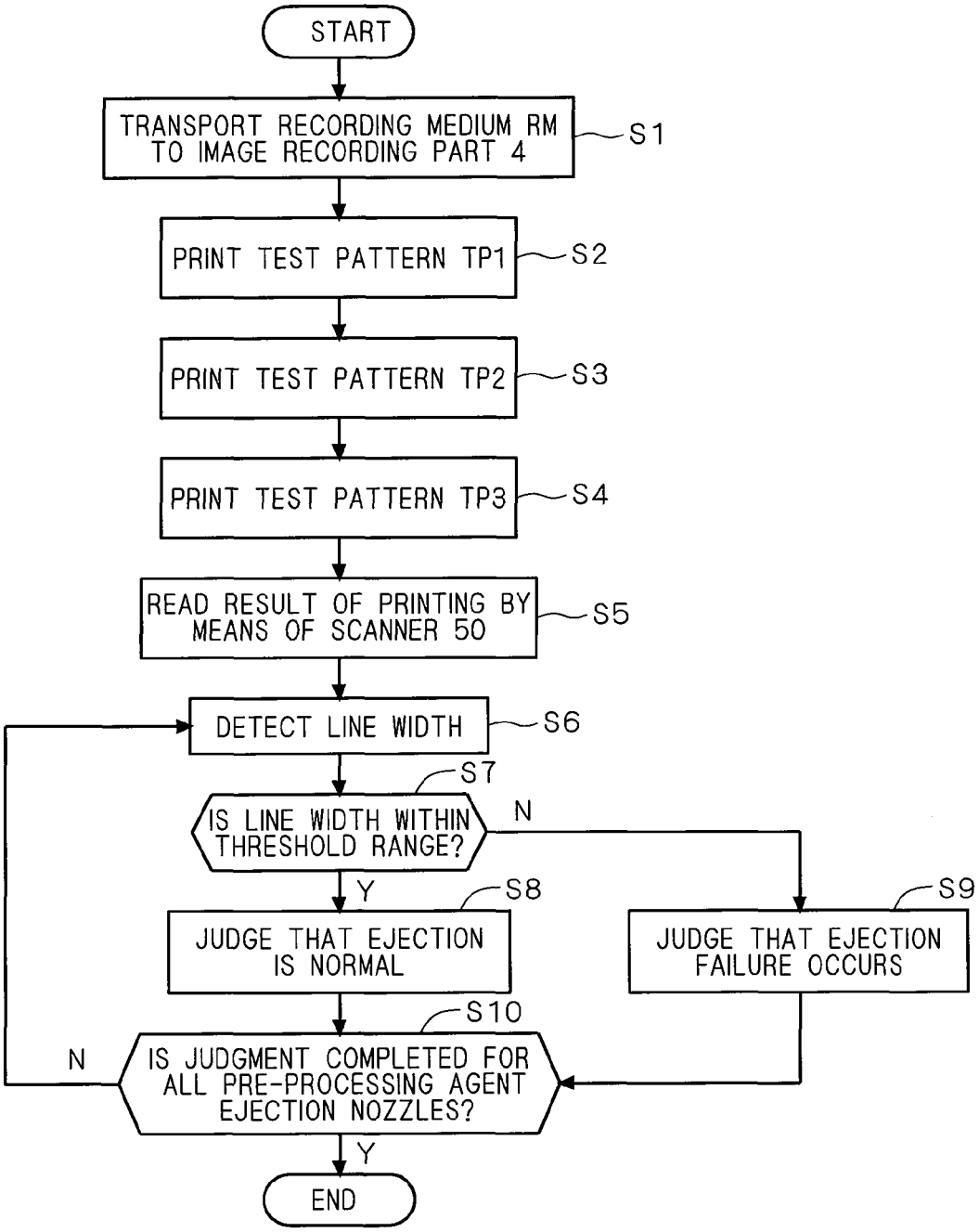
FIG. 5 is a flow diagram showing an ejection failure detection process.

FIG. 5 is a flow diagram showing the process of detecting the ejection failure in the pre-processing agent ejection nozzles. For the ejection failure detection process in the image recording apparatus 1, a recording medium RM is initially transported to the image recording part 4 (in Step S1).

Next, in the image recording part 4, the pre-processing agent is applied to the recording medium RM transported to a position opposed to the pre-processing agent ejection head 40 so as to form a predetermined test pattern TP1 (in Step S2).

Figure 6:
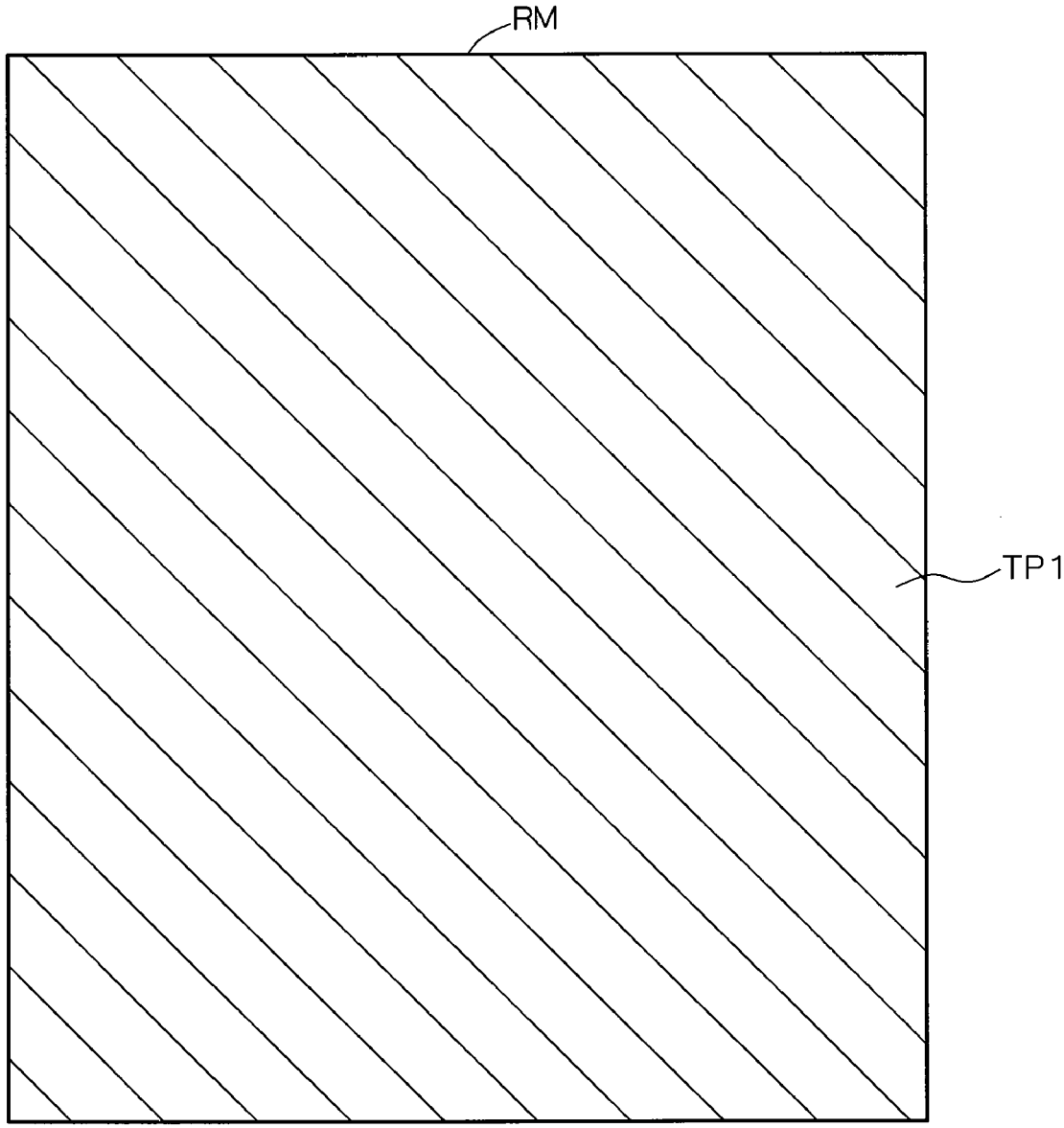
FIG. 6 is a view showing a test pattern.

FIG. 6 is a view showing the test pattern TP1. The test pattern TP1 is a printing pattern such that the pre-processing agent is applied to the entire surface of the recording medium RM at uniform density. For purposes of illustration, the test pattern TP1 is shown as shaded in FIG. 6. The timing and amount of ejection of the pre-processing agent for the formation of the test pattern TP1 are previously stored in the ROM 102 and the like.

Subsequently, the black ink is ejected and applied onto the recording medium RM transported to a position opposed to the recording head 41 so as to form a predetermined test pattern TP2 (in Step S3). The test pattern TP2 is a printing pattern formed by providing a time lag between the processes of ejecting ink from at least adjacent ones of the nozzles of the recording head 41.

Figure 7:
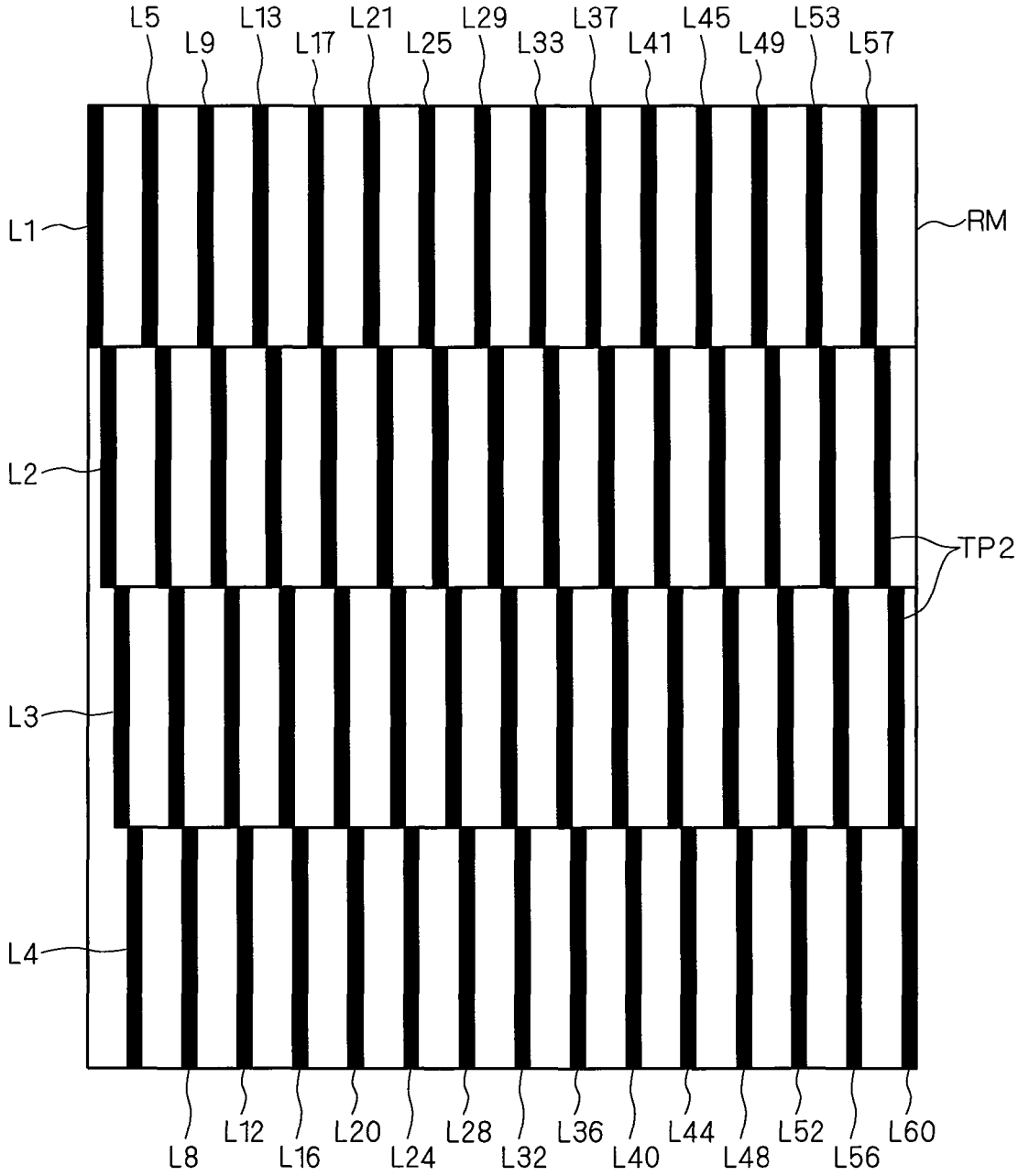
FIG. 7 is a view showing another test pattern.

FIG. 7 is a view showing an example of the test pattern TP2 formed in Step S3. The regions coated with the ink ejected from the nozzles N1 to N60 of the recording head 41 are referred to as lines L1 to L60, respectively. The formation of the test pattern TP2 is as follows. The nozzles of the recording head 41 are divided into 15 groups each composed of four nozzles capable of forming dots and arranged sequentially from bottom to top as seen in FIG. 3 (i.e., 15 groups composed of the nozzles N1 to N4, N5 to N8, N9 to N12, . . . , N53 to N56, and N57 to N60). In each of the groups, ink is ejected from the four nozzles with a time lag provided between adjacent ones of the nozzles so that the order in which the four nozzles eject ink is from bottom to top as seen in FIG. 3, starting at the lowermost nozzle (i.e., the nozzles N1, N5, N9, N13, . . . , N53 and N57). This provides a pattern printed stepwise.

The timing and amount of ejection of the black ink for the formation of the test pattern TP2, which is formed using the black ink in Step S3, are previously stored in the ROM 102 and the like. Information on the printing positions on the recording medium RM and the nozzles of the recording head 41 corresponding thereto is also stored in the ROM 102.

Subsequently, the yellow ink is ejected and applied onto the recording medium RM transported to a position opposed to the recording head 44 so as to form a predetermined test pattern TP3 (in Step S4). The test pattern TP3 is a printing pattern such that the yellow ink is applied to the entire surface of the recording medium RM at predetermined uniform density. That is, the region (or line) on the recording medium RM onto which the yellow ink is ejected and applied in Step S4 is similar to the region (or line) onto which the pre-processing agent is ejected and applied in Step S2 (with reference to FIG. 6).

The printing of the test patterns required for the ejection failure detection process is completed by performing the above-mentioned processes in Steps S1 to S4.

Figure 8:
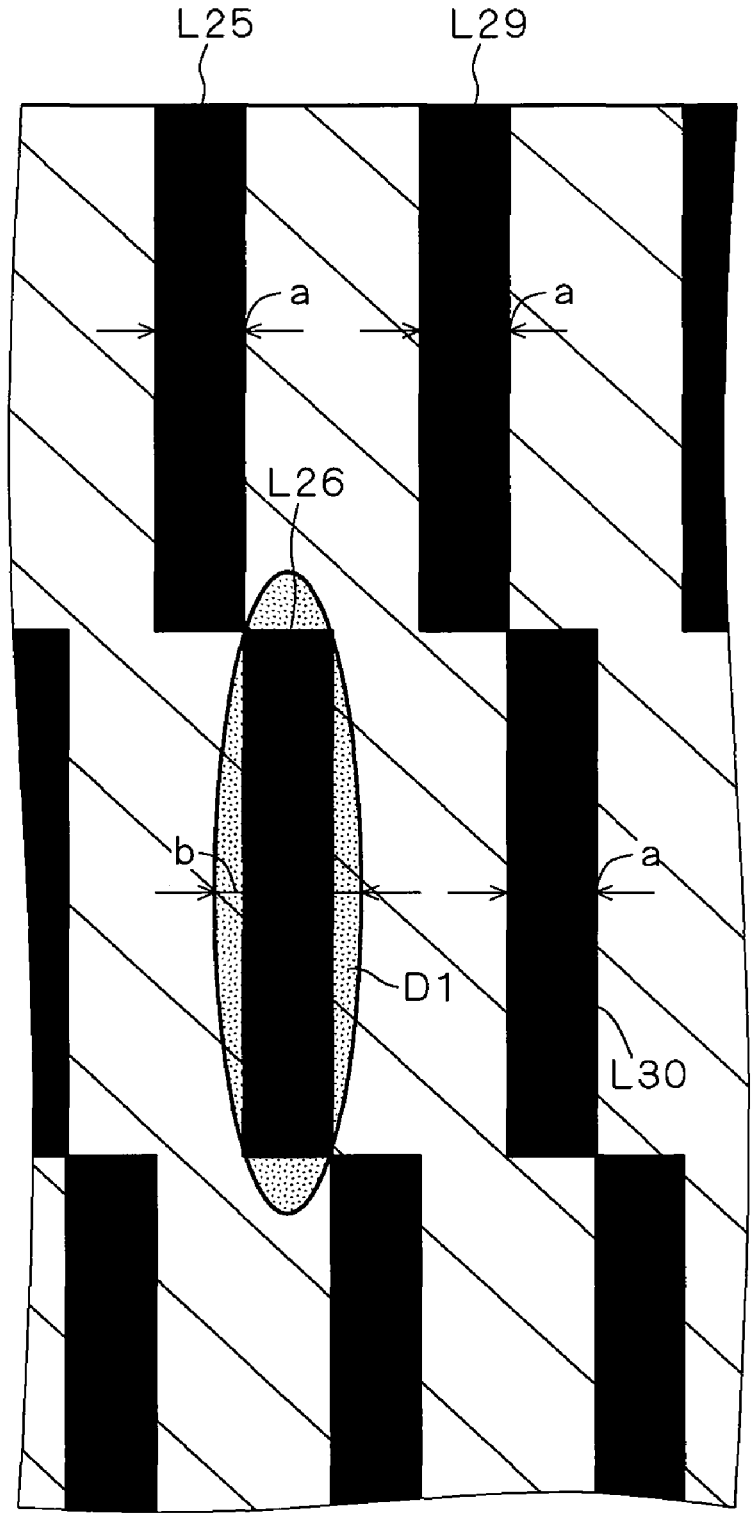
FIG. 8 is a fragmentary view on an enlarged scale illustrating a result of printing of the test patterns.

FIG. 8 is a fragmentary view on an enlarged scale illustrating an image formed on the recording medium RM by performing the above-mentioned processes in Steps S1 to S4. With reference to FIG. 8, the lines L25, L29 and L30 are lines formed when the pre-processing agent is ejected from the corresponding pre-processing agent ejection nozzles normally. When the pre-processing agent is applied normally, the ink ejected and applied onto the pre-processing agent is fixed with stability on the recording medium RM, so that the printed lines have a satisfactory width a.

The line L26, on the other hand, is a line formed by the black ink applied onto a region where the pre-processing agent is not well ejected. In this case, the black ink is not fixed with stability in the region where the line L26 is formed. This causes the yellow ink forming the test pattern TP3 and the black ink forming the test pattern TP2 to mix with each other, resulting in bleeding D1. The region where the bleeding D1 results have a width b which is greater than the satisfactory line width a. A pre-processing agent ejection nozzle for ejection onto the region where the bleeding D1 results can be judged to be a nozzle suffering the ejection failure.

When the process in Step S4 is completed, bleeding is present in a region of the test pattern TP2 corresponding to the nozzle suffering the ejection failure on the recording medium RM. This bleeding is visible to the naked eye, depending on the width of the line printed by means of a single nozzle and the color of the ink for printing the test pattern TP2. This enables the viewer to recognize that at least the ejection failure occurs. Whether a pre-processing agent ejection failure occurs or not is judged depending on whether ink bleeding is present or absent. This ensures the detection of the ejection failure even if the pre-processing agent less visible so that only the application thereof to the recording medium RM makes it difficult to detect the ejection failure is used.

A procedure for the process of identifying the pre-processing agent ejection nozzle suffering the ejection failure will be described in the following steps.

When the recording medium RM is transported to a position opposed to the scanner 50, the scanner 50 reads the image of the test patterns printed on the recording medium RM (in Step S5).

Subsequently, the failure judgment part 107 detects the width of each of the lines in the test pattern TP2 formed in Step S3 from the image acquired in Step S5 (in Step S6). The width of each of the lines in the test pattern TP2 is determined, for example, by performing a binarization process on the acquired image to discriminate between the printed patterns and other portions and then detecting the width of each of the lines. In the instance shown in FIG. 8, the width a is detected as the width of each of the lines L25, L28 and L29. The width b of the region where the bleeding D1 results is detected as the width of the line L26.

The failure judgment part 107 judges whether the width of the read line is within a previously determined threshold range or not (in Step S7). In other words, the failure judgment part 107 judges whether the width of each of the lines in the printed patterns on the recording medium RM which are formed as shown in FIG. 8 is within a predetermined range or not with respect to the satisfactory line width a.

When the line width is within the threshold range in Step S7, the failure judgment part 107 judges that the pre-processing agent is ejected normally from a corresponding one of the pre-processing agent ejection nozzles, and stores the result of judgment (in Step S8). Information indicating that the ejection from the nozzle is normal is stored, for example, in the RAM 103.

When the line width is outside the threshold range in Step S7, on the other hand, the failure judgment part 107 judges that the corresponding pre-processing agent ejection nozzle suffers the ejection failure, and stores the result of judgment (in Step S9). Information indicating that the nozzle suffers the ejection failure is stored, for example, in the RAM 103.

After the process in Step S8 or in Step S9 is completed, a judgment is made as to whether the detection of the width and the judgment as to whether the width is within the threshold value or not are made for the lines corresponding to all of the pre-processing agent ejection nozzles or not (in Step S1). When the detection of the line width and the judgment as to whether the line width is within the threshold value or not are not completed for all of the pre-processing agent ejection nozzles, the procedure returns to Step S6, and the detection of the line width and the judgment as to whether the line width is within the threshold value or not are subsequently made. When the detection of the line width and the judgment as to whether the line width is within the threshold value or not are completed for all of the pre-processing agent ejection nozzles, the results of judgment are outputted, and the ejection failure detection process is completed. The results of judgment are outputted, for example, by showing a correspondence between the positions of the respective pre-processing agent ejection nozzles and the normal/abnormal conditions of the ejection from the respective nozzles in list form either on a display device or as a print output.

The ejection failure in the pre-processing agent ejection nozzles is detected by the above-mentioned processes.

The process in Step S4 described above is a process intended for enhancing the ability to detect the nozzle suffering the ejection failure, that is, a process intended for improving the accuracy of the detection of the nozzle suffering the ejection failure. In this preferred embodiment, more bleeding is desirable in the test pattern TP2 formed in Step S3 because a time lag is provided between the processes of ejecting ink from the nozzles for forming at least adjacent dots. The execution of the process in Step S4 enables more bleeding to occur in a region corresponding to the pre-processing agent ejection nozzle suffering the ejection failure. This allows a clearer distinction between the nozzle suffering the ejection failure and the normally ejecting nozzles. Such a method enhances the ability to detect the nozzle suffering the ejection failure by increasing the amount of ink.

On the other hand, since the process in Step S4 is the process intended for enhancing the ability to detect the nozzle suffering the ejection failure, the detection of the ejection failure in the pre-processing agent ejection nozzles may be accomplished without executing the process in Step S4. In this case, the bleeding does not result from the mixing of the yellow ink and the black ink but the bleeding of the black ink alone occurs in the region where the pre-processing agent is not well ejected. The ejection failure may be detected by detecting such bleeding.

In this preferred embodiment as described above, the black ink and the yellow ink ejected after the application of the pre-processing agent onto the recording medium RM mix together in a region on the recording medium RM where the pre-processing agent is not well ejected from the pre-processing agent ejection nozzle to result in bleeding in the test pattern TP2 because of the low fixability of the black ink and the yellow ink to the recording medium RM. Thus, the ejection failure in the pre-processing agent ejection nozzles is detected by judging that the pre-processing agent ejection nozzle corresponding to the region where the bleeding results suffers the ejection failure.

Such detection of the ejection failure is especially effective when the pre-processing agent is less visible than the black ink used for the printing of the test pattern TP2 and the yellow ink used for the printing of the test pattern TP3 (e.g., when the pre-processing agent is transparent or substantially transparent).

Further, the result of printing of the test patterns is read by means of the scanner 50. The width of each of the lines formed by the printing of the test pattern TP2 is detected from the resultant read image, and the presence or absence of the ejection failure is judged based on the comparison between the width of each line and the predetermined threshold value. The nozzle suffering the ejection failure is identified based on the position of the formed line and the position of the pre-processing agent ejection nozzle relative to each other. This allows the detection of the nozzle suffering the ejection failure with reliability.

<Modifications>

In the above-mentioned preferred embodiment, the line head is used in which the plurality of head units each having the plurality of nozzles are arranged in a staggered configuration to achieve printing across the width of the recording medium RM in the direction orthogonal to the transport direction of the recording medium RM. Alternatively, a line head having a structure such that a plurality of nozzles are arranged in a line in the longitudinal direction of an elongated head body having a length greater than the entire width of the recording medium RM may be used.

The pre-processing agent ejection head 40 and the recording heads 41 to 44 are line heads in the above-mentioned preferred embodiment. However, the present invention is applicable to the pre-processing agent ejection head and the recording heads which are serial heads reciprocating along the width of the recording medium RM.

The colors of the ink printed on the recording medium RM in the processes of Steps S3 and S4 are not limited to those described in the above-mentioned preferred embodiment. In other words, the colors of the ink for use in Steps S3 and S4 may be changed in conjunction with the construction of the image recording part 4 in the image recording apparatus 1. It is, however, desirable that the color of the ink for use in Step S3 is highly visible and the color of the ink for use in Step S4 is moderately visible.

Subsequent to the process in Step S2, the printing of the test pattern TP3 in Step S4 may be performed, following which the printing of the test pattern TP2 in Step S3 is performed.

The black ink, the cyan ink, the magenta ink and the yellow ink are used in the above-mentioned preferred embodiment. However, the present invention is applicable when another color ink is used in addition to the four color inks described above. Also, the present invention is applicable to an apparatus for recording an image using a color other than black, cyan, magenta and yellow.

Printing of a test pattern for inspecting the ejection condition of another nozzle may be done in addition to the printing of the test pattern described above. For example, printing of a test pattern for inspecting the ejection conditions of the nozzles of the recording heads 41 to 44 may be done, following which the printing of the test patterns for detecting the ejection failure in the pre-processing agent ejection nozzles according to the present invention is done.

The patterns in Steps S2 and S4 are the test patterns TP1 and TP3 which are formed by applying the pre-processing agent and the ink, respectively, at uniform density on the entire surface of the recording medium RM in the above description, but are not limited thereto. Specifically, the pattern in Step S2 is not limited to the test pattern TP1, and the pattern in Step S4 is not limited to the test pattern TP3 but is required only to be substantially identical with the pattern formed in Step S2.

While the invention has been described in detail, the foregoing description is in all aspects illustrative and not restrictive. It is understood that numerous other modifications and variations can be devised without departing from the scope of the invention.

What is claimed is:

1. An image recording apparatus for recording an image based on inkjet technology, comprising:

a transport element for transporting a recording medium;

a first recording head having a plurality of ink ejection nozzles and for ejecting ink of a first color for image recording from said plurality of ink ejection nozzles based on inkjet technology;

a pre-processing agent ejection head having a plurality of pre-processing agent ejection nozzles and for ejecting a pre-processing agent for enhancing the fixability of said ink to said recording medium from said plurality of pre-processing agent ejection nozzles based on inkjet technology;

a controller for controlling a transport operation in said transport element and ejection operations in said first recording head and in said pre-processing agent ejection head, an image reading element for reading an image formed on said recording medium; and a failure judgment element for judging whether there is an ejection failure in said plurality of pre-processing agent ejection nozzles or not, based on a result of reading by means of said image reading element for said failure detection printing pattern, wherein the ejection positions of said plurality of pre-processing agent ejection nozzles and the ejection positions of said plurality of ink ejection nozzles on said recording medium as seen in a direction orthogonal to a transport direction in which said recording medium is transported by said transport element are in a one-to-one correspondence with each other, wherein, while causing said transport element to transport said recording medium, said controller causes the process of detecting an ejection failure in said plurality of pre-processing agent ejection nozzles by causing the following processes of:

ejecting said pre-processing agent from said plurality of pre-processing agent ejection nozzles onto substantially an entire surface of said recording medium at uniform density; and ejecting the ink of said first color from said plurality of ink ejection nozzles onto said recording medium after the ejection from said plurality of pre-processing agent ejection nozzles so as to form a failure detection printing pattern, said failure detection printing pattern being a printing pattern including a plurality of lines formed by the ejection of ink from different ones of said ink ejection nozzles with providing a time lag between the processes of ejecting the ink from adjacent ones of said plurality of ink ejection nozzles, and wherein said failure judgment element detects the width of each of said plurality of lines formed by the ink of said first color, and when there is an excess-width line having a width falling outside a predetermined threshold value among said plurality of lines, said failure judgment element judges that a pre-processing agent ejection nozzle corresponding in said ejection position to an ink ejection nozzle of said first recording head which is used to form said excess-width line is a nozzle suffering the ejection failure.

2. The image recording apparatus according to claim 1, further comprising:

a second recording head having a plurality of ink ejection nozzles and for ejecting ink of a second color from said plurality of ink ejection nozzles based on inkjet technology, said second color being different from said first color, wherein, in the process of detecting the ejection failure in said plurality of pre-processing agent ejection nozzles, said controller causes the following processes of:

ejecting said pre-processing agent;

ejecting the ink of said first color after the ejection of said pre-processing agent; and ejecting the ink from said plurality of ink ejection nozzles of said second recording head onto substantially the entire surface of said recording medium at uniform density after the ejection of the ink of said first color.

3. A method of detecting an ejection failure in a plurality of pre-processing agent ejection nozzles in an image recording apparatus for recording an image based on inkjet technology by ejecting a pre-processing agent from the plurality of pre-processing agent ejection nozzles and ejecting ink from a plurality of ink ejection nozzles while transporting a recording medium, said method comprising:

(a) transporting said recording medium;

(b) ejecting said pre-processing agent for enhancing the fixability of ink from said plurality of pre-processing agent ejection nozzles included in a pre-processing agent ejection head onto substantially an entire surface of said recording medium at uniform density;

(c) ejecting the ink of a first color from said plurality of ink ejection nozzles onto said recording medium after the ejection from said plurality of pre-processing agent ejection nozzles so as to form a failure detection printing pattern, said failure detection printing pattern being a printing pattern formed by providing a time lag between the processes of ejecting the ink from adjacent ones of said plurality of ink ejection nozzles included in a first recording head, wherein the ejection positions of said plurality of pre-processing agent ejection nozzles and the ejection positions of said plurality of ink ejection nozzles, as seen in a direction orthogonal to a transport direction in which said recording medium is transported, are in a one-to-one correspondence with each other;

(d) reading said failure detection printing pattern formed on said recording medium by means of an image reading element included in said image recording apparatus; and (e) judging whether there is an ejection failure in said plurality of pre-processing agent ejection nozzles or not, based on a result of reading by means of said image reading element for said failure detection printing pattern, wherein said failure detecting printing pattern includes a plurality of lines formed by the ejection of ink from different ones of said ink ejection nozzles, and wherein said step (e) includes:

(e-1) detecting the width of each of said plurality of lines formed by the ink of said first color, and (e-2) when there is an excess-width line having a width falling outside a predetermined threshold value among said plurality of lines, judging that a pre-processing agent ejection nozzle corresponding in said ejection position to an ink ejection nozzle of said first recording head which is used to form said excess-width line is a nozzle suffering the ejection failure.

4. The method according to claim 3, further comprising:

(f) ejecting the ink of a second color from said plurality of ink ejection nozzles included in a second recording head onto substantially the entire surface of said recording medium at uniform density after the ejection of the ink of said first, said second color being different from said first color.

* * * * *